US009297156B2

(12) United States Patent
Grimaldi

(10) Patent No.: US 9,297,156 B2
(45) Date of Patent: Mar. 29, 2016

(54) BELLOWS-LIKE FOLDABLE TOILET BOWL

(75) Inventor: Folco Grimaldi, Sorrento (IT)

(73) Assignee: NON SOLO YACHTING S.A.S. DI SALZANO ALESSANDRO E GRIMALDI ORFEO PAOLO, Benevento (BN) (IT)

( * ) Notice: Subject to any disclaimer, the term of this patent is extended or adjusted under 35 U.S.C. 154(b) by 858 days.

(21) Appl. No.: 13/503,138

(22) PCT Filed: Oct. 19, 2010

(86) PCT No.: PCT/IB2010/054728
§ 371 (c)(1),
(2), (4) Date: Apr. 20, 2012

(87) PCT Pub. No.: WO2011/048544
PCT Pub. Date: Apr. 28, 2011

(65) Prior Publication Data

US 2012/0198609 A1 Aug. 9, 2012

(30) Foreign Application Priority Data

Oct. 23, 2009 (IT) ..... RM2009A0544

(51) Int. Cl.
*E03D 11/12* (2006.01)

(52) U.S. Cl.
CPC ..... *E03D 11/12* (2013.01)

(58) Field of Classification Search
CPC ..... A47K 13/10; E03D 11/12; E03D 11/13
USPC ..... 4/312
See application file for complete search history.

(56) References Cited

U.S. PATENT DOCUMENTS

| | | | | |
|---|---|---|---|---|
| 2,879,519 | A * | 3/1959 | Mueller | 4/312 |
| 3,436,764 | A | 4/1969 | Colonna | |
| 4,348,776 | A * | 9/1982 | Sarjeant | A47K 13/08 4/300.3 |
| 4,944,047 | A * | 7/1990 | Gagliano | 4/312 |
| 6,038,708 | A * | 3/2000 | Schreck | A47K 13/10 4/244.1 |
| 6,367,094 | B1 * | 4/2002 | Gagliano | 4/312 |
| 6,430,879 | B1 * | 8/2002 | Nuiry | E04B 1/34305 4/498 |
| 2004/0078880 | A1 * | 4/2004 | Hewton | 4/246.1 |

FOREIGN PATENT DOCUMENTS

WO 03/074800 9/2003

OTHER PUBLICATIONS

International Search Report dated Feb. 15, 2011, corresponding to PCT/IB2010/054728.

* cited by examiner

*Primary Examiner* — Janie Christiansen
(74) *Attorney, Agent, or Firm* — Young & Thompson

(57) ABSTRACT

A toilet bowl provides maximum flexibility in installation and use. Substantially, the bellows-like closing and opening (foldability) of the bowl allows the mounting in very restricted settings, even if the bowl preferably has a standard size. The use of simple, manual or automatic systems in order to pass from open to closed positions, and vice versa, allows an easy use that does not nullify the advantages in terms of bulk. The advantages are also increased by the possibility to use a suction pump, since in such a manner not only will there be the benefits regarding bulk but also those due to the possibility of using a minimal quantity of water during discharge; of course, it is still possible to equip the pump with the normal "siphon" discharge system. The bowl is perfectly watertight, since between the strips of the "bellows", there are suitable, perfectly cleanable gaskets with self-cleaning function.

16 Claims, 5 Drawing Sheets

BELLOWS-LIKE FOLDABLE TOILET BOWL

FIELD OF THE ART

The present invention regards sanitary articles for toilets, in particular a toilet bowl, to install in private homes and elsewhere, on boats or on other self-propelled means, and on other means such as trains, preferably but not exclusively where the space available is rather limited and the availability of water is limited, since it is able to self-clean after use in a mechanical manner.

STATE OF THE ART

Currently, toilet bowls constitute rigid, monolithic elements of considerable size and reduced flexibility of use in terms of installation. In particular, in situations where the toilet bowl must be situated in a restricted space, such need was exclusively met by "miniaturizing" a bowl of standard type, with considerable difficulty of use by the user and sometimes truly hindering use due to the size/build of the user himself, for example.

Therefore, there is the need to provide a toilet bowl which solves the following problems:

reduction of the bulk of the conventional toilet bowls;

simplicity and ease of use notwithstanding the reduced bulk;

convenient cost;

use of standard technologies which do not involve a cost increase due to apparatuses/means achieved ad hoc for obtaining the desired objects.

DESCRIPTION OF THE INVENTION

The aforesaid objects are obtained by means of a toilet bowl of the type defined in the claims.

Several advantageous but more specific variants are defined in the dependent claims. The present invention attains its main object by providing a toilet bowl usable in particular in areas with limited or even quite restricted space, having a fixed part or structure (1) connectable in a direct or indirect manner to a floor or wall, said fixed part (1) having an inlet (3) for the water and said toilet bowl also having, on its lower part, a discharge (8) for the water to be discharged directly into the sewer or into a suitable hygienic collection container, characterized in that one or more strips or shells (2) are mounted on said fixed part (1) in a manner such that they can rotate around a substantially horizontal axis, i.e. around respective hinges (15) on the fixed part (1) itself, wherein, in the use position of the toilet bowl, said strips (2) are superimposed on each other to a minimum extent and an upper strip (2) has a substantially horizontal upper edge defining the lateral borders of the toilet bowl, while in a non-use position of the toilet bowl, said strips (2) are superimposed on each other to a maximum extent and are all assembled together, i.e. housed at least in part but preferably completely inside said fixed part or structure (1).

Preferably, a manual or automatic command is provided for, for opening the toilet bowl, i.e. for moving the strip group (2) from said non-use position of the toilet bowl towards its use position, such command preferably being an electric servocontrol.

Preferably, the toilet bowl comprises gas springs (11) connectable between a fixed element, for example a wall, and said movable strip (2) group.

Preferably, in the toilet bowl, in order to ensure the watertight seal between one strip (2) and the preceding or subsequent strip (2), gaskets (5, 5') are provided for, acting between the walls of the single strips (2) and also having self-cleaning function.

Preferably, in a more specific variant of the invention, the gaskets (5, 5') are arranged on an upper projection (4) and on a lower projection (4'), respectively, of every strip (2), wherein, for every contiguous strip pair (2*a*, 2*b*), the upper projection (4) and the relative gasket (5) of the lower strip (2*a*) of this strip pair are directed towards the outer wall of the upper strip (2*b*), whereas the lower projection (4') and the relative gasket (5') of the upper strip (2*b*) of this strip pair are directed towards the inner wall of the lower strip (2*a*), so as to not create concavities or niches where the dirty matter in the toilet bowl could be accumulated.

In order to use a minimum quantity of water, with the normal use for the "siphon" system discharge, the toilet bowl of the invention can also comprise an evacuation pump, possibly electric. In such a manner, the advantages of an already known technology are united with those of a toilet bowl that is extremely compact but has standard dimensions during use.

Preferably, the strips will be constituted by rather light but very strong material (e.g. metal, composite material, thermoplastic material, thermosetting material, natural material). Heavy material could even be used.

The pump, provided with non-"siphon" discharge, is associated with a seal gasket arranged between the pump itself and a lower fixed section (9; 9'), placed on the discharge (8) possibly directly below said fixed part or structure (1), the gasket being made, for example, of elastomeric material which ensures the seal, and being easy to dismantle, preferably by means of a screw connection.

In a preferred embodiment of the invention, the toilet bowl is provided with a simple locking system with a spring latch for locking the group of strips (2) in the open position, such system being releasable manually or via an electric servocontrol which automatically brings the strips (2) back towards said non-use position.

Preferably, the manual or electric command for releasing the strips from their open position is not activatable if the discharge pump of the water from the toilet bowl has not been previously actuated.

Advantageously, in another embodiment, the command, in this case electric, for closing the bowl, i.e. for bringing it back towards its non-use and minimum bulk position, is automatically activated by means of a timer, after a possibly settable predetermined time has elapsed from the last actuation of the discharge pump.

BRIEF DESCRIPTION OF THE DRAWINGS

The present invention will now be described in a more detailed manner, but only as exemplifying and non-limiting or non-binding with reference to several currently preferred embodiments thereof, shown in the enclosed drawings, in which.

DESCRIPTION OF SOME SEVERAL PREFERRED EMBODIMENTS OF THE INVENTION

With reference to the preceding drawing and to the various numeric references (always the same in all the figures in order to avoid confusion), the present invention will now be described more in detail, without however going into too much detail on those items which would not be a problem for a man skilled in the art to achieve. Therefore, the object of this part of the description is to place a man skilled in the art in the conditions of being able to actuate the invention, without spending too much time on details that are obvious for such man.

In addition, the practical embodiments described herein are only a small part of the diverse variants and respective technical equivalents which could come to the mind of a man skilled in the art, without departing from the protective scope which is due to the present finding.

Figure 1:
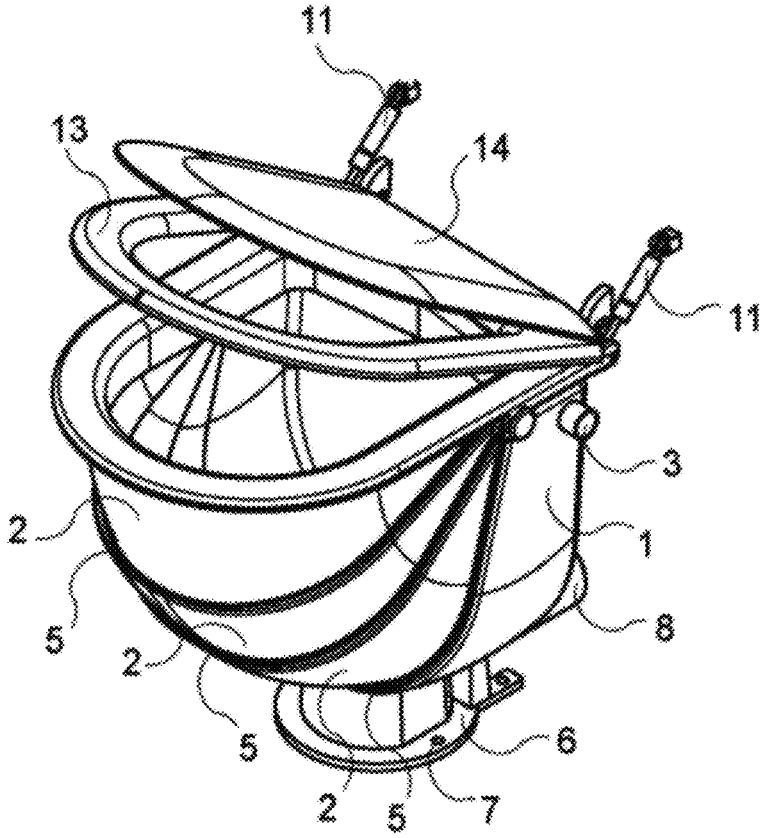
FIG. 1 is a perspective view of a first embodiment of a toilet bowl according to the present invention, in open position.

With reference to FIG. 1, this shows the perspective view of a toilet bowl mountable on the floor. The fundamental characteristic of the present invention, shared by all the embodiments, consists of the fact that unlike conventional bowls, this is "foldable", in the sense that it comprises a fixed part or structure 1 in which one or more shaped elements are housed (in closed position of the toilet bowl), such shaped elements are termed strips (or shells) 2, and they have a specific curvature; such strips 2, sliding into each other, can be opened/raised, starting from the closed position of FIG. 2, up to the completely open and locked position (FIG. 1), in order to obtain a toilet bowl of standard size. Therefore, the toilet bowl of the present invention is a "bellows-like foldable" toilet bowl.

Figure 5:
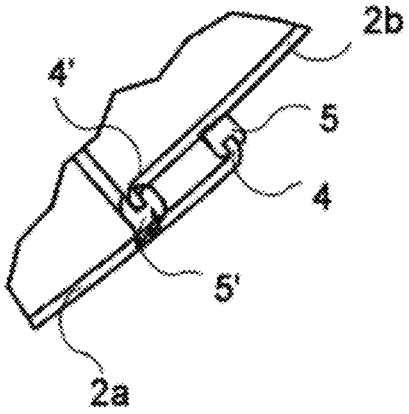
FIG. 5 shows the detail of the gaskets of the strips or shells.

The single strips 2 lack protrusions on their body, but are equipped with projections 4 and 4' (see FIG. 5), suitable for receiving the gaskets 5 and 5' which ensure the watertight seal in all the mutual positions of the strips 2. More precisely, in the transition zone between one strip 2 and the other, as FIG. 5 shows, the lower strip 2*a* has a projection 4 directed towards the interior of the toilet bowl, while the upper strip 2*b* has a projection 4' directed towards the exterior of the toilet bowl. The projection 4 receives the gasket 5 which is always in contact against the outer wall of the upper strip 2*b*, while the projection 4' receives an analogous gasket which however is in contact with the inner wall of the lower strip 2*a*. Said gaskets 5, 5' will be respectively placed in the upper part and lower part of each single strip 2 (except for, possibly, the upper part of the strip 2 situated at the highest point in the open position of the "bellows"), and in addition, a gasket 5 will also be provided for in the fixed part or structure 1, and this will cooperate with the gasket 5' of the lower strip in order to ensure the seal in the lower transition point, i.e. between the fixed part 1 and the strip 2 situated at the lowest level.

From the drawings (in particular from FIG. 5), it is observed that the arrangement of the gaskets 5, 5' and the projections 4, 4' was deliberately selected in order to prevent that concavities/niches are formed on the inner wall of the strips 2, in the transition points between one strip and the next. In this manner, the toilet bowl can be maintained in a perfectly-clean condition, periodically washing and disinfecting the gaskets.

The watertight seal gaskets 5, 5' can be made of synthetic, natural or silicon elastomers, for example.

Figure 2:
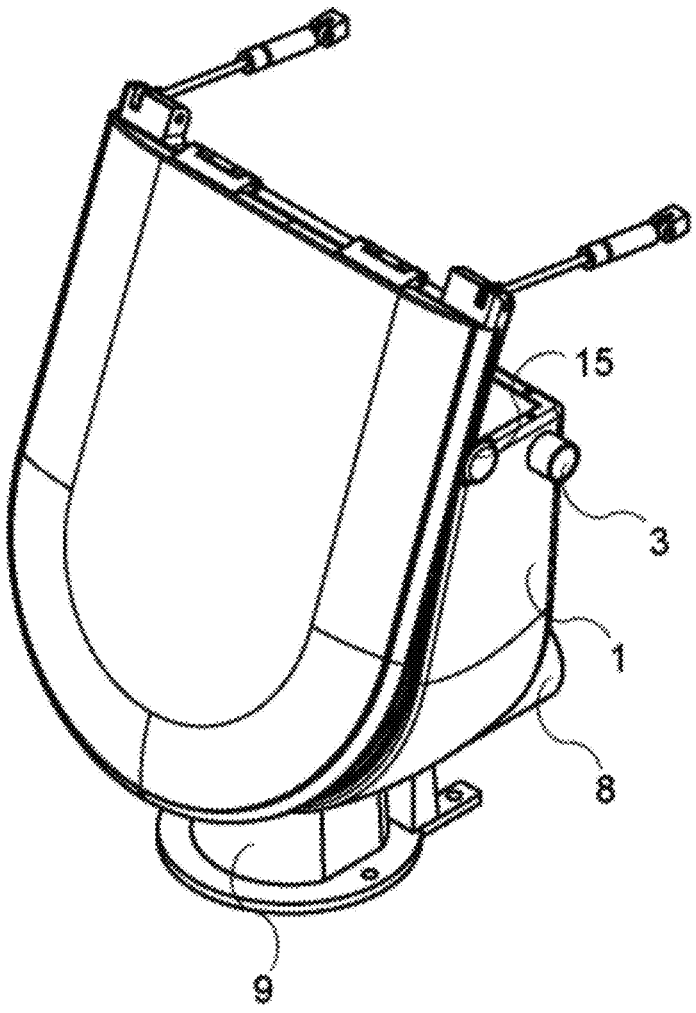
FIG. 2 is a view analogous to that of FIG. 1, but in the closed position of the toilet bowl of the invention.
Figure 3:
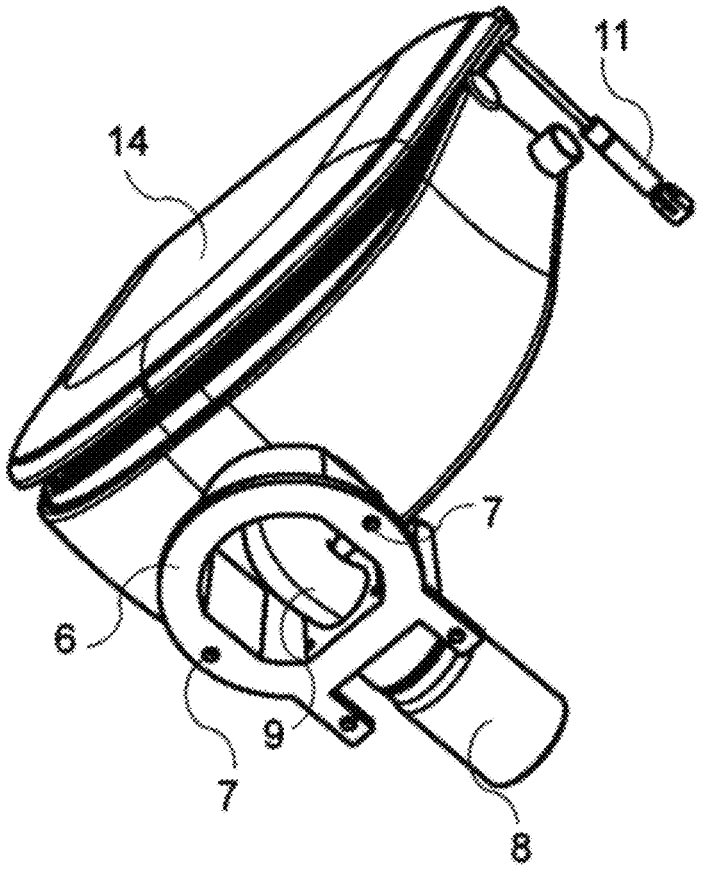
FIG. 3 is a bottom perspective view of the first embodiment of the toilet bowl according to the present invention, already shown in FIGS. 1 and 2, once again in closed position.

In addition, the gasket 4' has a self-cleaning effect since it periodically "scrapes" against the inner wall of the lower strip 2*a*, each time that the toilet bowl is brought from the open condition shown in FIG. 1 into the bellows-like closed position shown in FIG. 2. In the latter position, the toilet bowl, in addition to having standard size, also has minimal bulk.

The discharge of the organic substances and the content of the bowl can also be ensured by means of the activation of an electric pump of commercial type (not shown) or also by any other pump that is deliberately designed and adapted for particular installations.

The system can also function as an external flusher, i.e. for cleaning, a small quantity of water is allowed to enter via gravity through the water inlet duct 3 (shown in FIG. 1 in the upper part of the structure 1). Such water quantity is preferably comprised between 100 and 1000 cl, always falling within that allowed by the current laws of the countries where the system is sold; the water is then extracted/sucked by the pump.

The water discharge system can also work under "dry" conditions; i.e. when it is used, there is not a significant amount of water inside the bowl itself, neither before nor during use. Abundant water enters only for a brief instant after the activation of the pump itself, which can also be manual and actuatable via button or lever. The command of the pump can be situated on the wall (lever, button) or on the floor (pedal, metal button), or on the structure itself.

Between the pump and the bowl, an elastomeric seal gasket ensures the watertight seal. Such gasket is easily substitutable over time by means of the simple disassembly of the bowl, by means of a screw connection. The number of screws can vary with the type of pump used.

The material for producing the toilet bowl of the present invention can be, for example:

metal (steel and its alloys, aluminum and its alloys);

composite material (glass fiber, carbon fiber, aramid resin fiber);

thermoplastic material (any type, loaded or otherwise);

thermosetting material;

natural material (all fibrous materials and non-fibrous materials, biocompatible materials).

The toilet bowl according to the present invention can be fixed to the floor and/or to the wall. For example, in the first embodiment of FIGS. 1, 2, 3 and 4, the bracket 6 is observed with screws 7 for fixing to the floor. The discharge is horizontal and is schematically indicated by the tube with the number 8. The system of the discharge pump with seal etc. is situated inside the discharge 8 and more precisely in the part indicated by the number 9 (FIGS. 1, 2, 3, 4) inside/on top of the mounting bracket 6.

Figure 6:
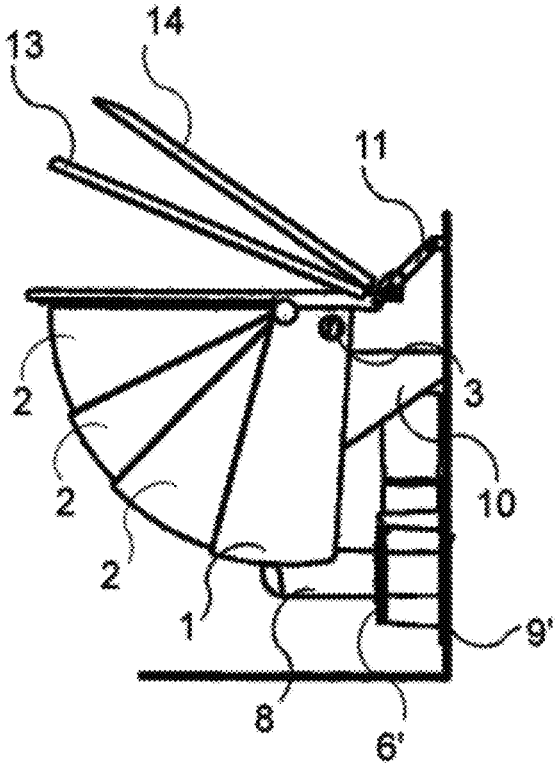
FIG. 6 is a side view of a second embodiment of the invention, with regard to the wall mounting.

FIG. 6 instead shows a second wall mounting embodiment of the toilet bowl of the present invention. In such case, in order to ensure the support, a support element 10 to the wall is provided for (see FIG. 6). In the mounting bracket 6', the suction system with the pump is provided for, schematized with 9'. Otherwise, the two embodiments are equivalent.

Also provided for is the possibility to fix the "bellows-like foldable toilet bowl" of the present invention on an accessory service structure (not represented in the drawings) which constitutes a service element in the environment where it is situated. If requested, such structure can also have an aesthetic function.

Figure 4:
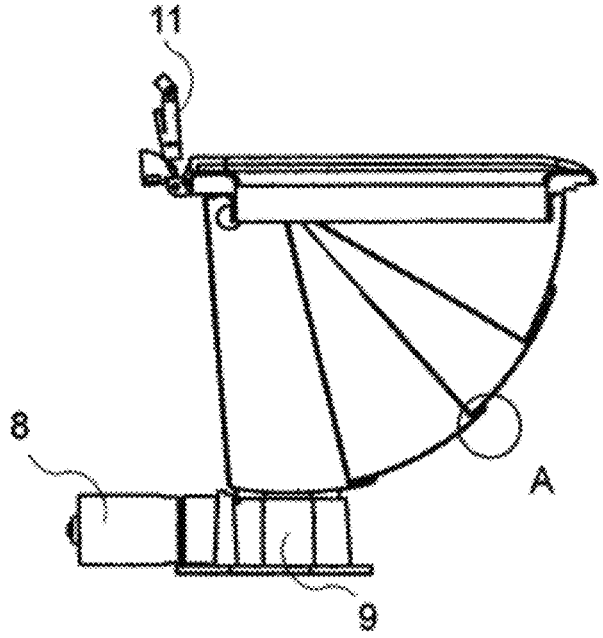
FIG. 4 is a side view, more schematic, of the toilet bowl of the preceding figures.

The opening of the strips 2, towards the open position shown in FIG. 1 and in FIGS. 4 and 6, is ensured by a mechanism actuatable by a (manual or automatic) command typically placed on the top or on the side of the fixed part 1.

Therefore, an electric motor will be possibly placed for the automatic lifting of the strips 2.

Figure 7:
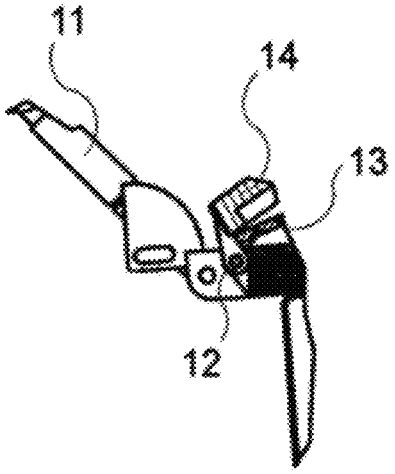
FIG. 7 is a detail related to the spring latch (system for locking the strips in open position), in which the hinge is also shown of the toilet seat and toilet seat cover of the toilet bowl.

For the seal of the bowl in open position and for the lowering of the strips 2, a spring latch system is provided for, only schematized in FIG. 7. The spring latch is made of metal or of an equally-strong material. The spring latch is manually or electrically commanded by means of a servocontrol. Alternatively, the user slightly lifts (with his hand) the upper strip in order to release the spring latch and a spring brings the strips into closed position. In order to prevent the strips 2 from falling sharply towards the closed position shown in FIGS. 2 and 3, pneumatic dampers 11 are provided for (gas springs). FIG. 7, with 12, schematically shows the hinge/rotation axis of the toilet seat and toilet seat cover 13, 14 and with 15 (in FIG. 2) the hinge/rotation axis of the strips 2 is shown.

The sequence of "placing the bowl in rest position" after use in order to "bring it back close to the wall", into the position best shown in FIG. 2, cannot occur without the preceding start of the toilet bowl cleaning system.

In other embodiments, the closure system could be automated, also by means of a timer which would automatically activate the electric servocontrol for actuating the cleaning system and then bowl closure (movement of the strips 2) after a predetermined time period has elapsed from the closure of the cover. In this case, the toilet bowl would normally (i.e. automatically) return into closed position after use.

By providing for a pressure sensor on the toilet seat, also the discharge could be automated.

In a further embodiment, the toilet bowl of the present invention can be housed in a shower stall created ad hoc, where, once placed in closed position and covered with a suitable structure (that can be made with one or more of the materials usable for the construction of the toilet bowl of the present invention), it will form a convenient stool for use of the shower itself.

In addition, the toilet bowl of the present invention can be equipped with a small freshwater "spray head", both inside the fixed part and outside (not shown in the figures), useful for the purposes of personal hygiene.

A further spray head could be mounted outside the fixed structure (or rather inside the latter) for cleaning the toilet bowl of the present invention.

All of these variants are within the reach of a man skilled in the art and therefore will not be further discussed.

As merely exemplifying and non-limiting, the following possible dimensions of the bowl are indicated:

width: comprised between 260 and 450 mm, preferably about 361 mm;

height: comprised between 220 and 700 mm, preferably about 423 mm; depth, i.e. total projection from the wall in the closed position of the bowl: comprised between 50 and 400 mm, preferably about 348 mm.

INDUSTRIAL APPLICATION

The toilet bowl of the present invention, in addition to the home and public environment, has one its natural applications in nautical use. Given that it can be fixed both to the wall and to the floor, and that it has an evacuation pump that allows a freedom of positioning of the entire system, it is perfectly set in the rooms and areas intended for use as bathrooms on a boat (whether a recreation or work craft).

The same characteristics and the possibility of having even smaller versions (with regard to the total bulk) make this toilet bowl of the present invention naturally applicable to the field of campers and TIR trucks.

A further possible application of the toilet bowl of the present invention is that of the prefabricated housing field, for modules of small size. In this case, the area intended to be used as a toilet can have small size, since the toilet bowl can be inserted in a furniture piece due to its "foldability" and installation simplicity. For such purpose, a furnishing module is provided, which together with the bowl also has the function of mirror and sink.

The bellows-like foldable toilet bowl according to the present invention allows obtaining two antithetical advantages: a toilet bowl of standard size (in open condition), and at the same time a toilet bowl installable without problems in limited spaces or even in quite restricted areas. It can also be self-cleaning, due to the system of tiltable strips equipped with suitable gaskets, which by scraping along the edges of the walls ensure the total cleaning of the bowl.

The invention claimed is:

1. A toilet bowl comprising:

a fixed part (1) connectable in a direct or indirect manner to a floor or wall, said fixed part (1) having an inlet (3) for supply of water, and a discharge (8) for discharging the water, wherein said fixed part (1) includes hinges (15), and includes strips (2) mounted to the fixed part in a manner to rotate relative to one another about the hinges (15) on the fixed part (1), wherein, in a first use position, said strips (2) are superimposed over each other to a minimum extent and collectively assume the form of a bowl, an upper strip of said strips (2) having a substantially horizontal upper edge defining the lateral borders of the toilet bowl, whereas in a second non-use position said strips (2) are superimposed over each other to a maximum extent greater than said minimum extent such that all the strips (2) are assembled together and housed at least in part inside said fixed part (1), and gaskets (5, 5') positioned between walls of individual ones of the strips (2) and configured to perform a self-cleaning function, wherein said gaskets (5, 5') are arranged on an upper projection (4) and on a lower projection (4'), respectively, of every one of the strips (2), wherein, for every contiguous strip pair (2*a*, 2*b*), comprising a lower strip (2*a*) of the strips and an upper strip (2*b*) of the strips, the upper projection (4) and a gasket (5) of the lower strip (2*a*) are directed towards an outer wall of the upper strip (2*b*), whereas the lower projection (4') and a gasket (5') of the upper strip (2*b*) are directed towards an inner wall of the lower strip (2*a*).

2. The toilet bowl according to claim 1, further comprising:

a mechanism, for opening the toilet bowl, that moves the strips (2) from said second non-use position towards said first use position.

3. The toilet bowl according to claim 2, further comprising:

gas springs (11) connectable between a fixed element, and said movable the strips (2).

4. The toilet bowl according to claim 2, further comprising:

a locking system with a spring latch for locking the strips (2) in the first use position, such system being releasable via an electric servocontrol which automatically moves the strips (2) towards said second non-use position.

5. The toilet bowl according to claim 2, wherein the mechanism for opening the toilet bowl comprises an electric servocontrol.

6. The toilet bowl according to claim 1, further comprising:

gas springs (11) that connect said strips (2) to a fixed element or wall.

7. The toilet bowl according to claim 1, further comprising: an evacuation pump.

8. The toilet bowl according to claim 7, further comprising: a seal gasket, located between the evacuation pump and a lower fixed section (9; 9') of the toilet bowl, positioned on the discharge (8).

9. The toilet bowl according to claim 8, wherein the seal gasket is positioned on the discharge directly below the fixed part.

10. The toilet bowl according to claim 8, wherein the gasket is made of elastomeric material, and is held in place via a screw connection.

11. The toilet bowl according to claim 7, wherein the evacuation pump is electric.

12. The toilet bowl according to claim 1, further comprising:

a locking system with a spring latch for locking the strips (2) in the first use position, such system being releasable via an electric servocontrol which automatically moves the strips (2) towards said second non-use position.

13. The toilet bowl according to claim 12, wherein the electric servocontrol for releasing the strips from the first use position is prevented from operating when a discharge pump of the water from the toilet bowl has not been previously actuated.

14. The toilet bowl according to claim 13, wherein the electric servocontrol is automatically activated, by means of a timer, to move the strips (2) from said first use position to said second non-use position after a predetermined time has elapsed from a last actuation of the discharge pump.

15. The toilet bowl according to claim 1, wherein all the strips (2) are assembled together and housed completely inside said fixed part.

16. The toilet bowl according to claim 1, further comprising:

a locking system with a spring latch for locking the strips (2) in the open position, such system being manually releasable.

* * * * *